United States Patent [19]

Tokura et al.

[11] Patent Number: 4,702,221

[45] Date of Patent: Oct. 27, 1987

[54] IGNITION DEVICE FOR AN INTERNAL COMBUSTION ENGINE

[75] Inventors: Norihito Tokura, Nukata; Hisasi Kawai, Toyohashi; Masahiro Goto, Nukata; Seiji Morino, Okazaki; Masato Soumiya, Anjo, all of Japan

[73] Assignees: Nippon Soken, Inc.; Nippondenso Co., Ltd., both of Aichi, Japan

[21] Appl. No.: 924,423

[22] Filed: Oct. 29, 1986

[30] Foreign Application Priority Data

Oct. 31, 1985 [JP] Japan ..... 60-245918

[51] Int. Cl.[4] ..... F02P 3/04

[52] U.S. Cl. ..... 123/606; 123/621; 123/644; 315/209 T

[58] Field of Search ..... 123/606, 621, 637, 644, 123/655; 315/209 T, 209 SC, 209 M

[56] References Cited

U.S. PATENT DOCUMENTS 3,218,512 11/1965 Quinn ..... 315/209 T
4,117,818 10/1978 Bodig et al. ..... 123/621
4,285,322 8/1981 Ina et al. ..... 123/630
4,320,735 3/1982 Canup ..... 123/606
4,326,493 4/1982 Merrick ..... 123/606
4,356,807 11/1982 Tokura et al. ..... 123/606
4,641,626 2/1987 Morino et al. ..... 123/621

*Primary Examiner*—Andrew M. Dolinar
*Attorney, Agent, or Firm*—Cushman, Darby & Cushman

[57] ABSTRACT

In an ignition device for an internal combustion engine, the ignition device comprises: three closed circuits including first, second and third closed circuits, each circuit having at least a DC power source, a primary coil and a switching transistor; an ignition coil having three primary coils and a secondary coil; an ignition command signal generating means producing first and second ignition command signals, the first ignition command signal being applied to the third closed circuit and the second ignition command signal being applied to the control circuit; and a control circuit for causing the first and second switching elements to push-pull operate based on the input timing of the second ignition command signal.

9 Claims, 12 Drawing Figures

IGNITION DEVICE FOR AN INTERNAL COMBUSTION ENGINE

BACKGROUND OF THE INVENTION

1. Field of the Invention

The present invention relates to an ignition device for an internal combustion engine, more particularly to an ignition device of the alternating current (AC) continuous discharge type for controlling the primary coil current in an ignition coil.

2. Description of the Related Art

A conventional ignition device of the AC continuous discharge type has been disclosed, for example, in U.S. Pat. No. 4,356,807 (issued Nov. 2, 1982).

This conventional device can control the time of the discharge duration ranges of the ignition plug (spark plug) in one combustion stroke of the internal combustion engine. In this conventional device, an average discharge current range becomes more than 50 (mA), and thus this high average discharge current makes possible a so-called "high energy ignition" and can improve the ignition of the air/fuel mixture.

Nevertheless, a problem arises in this conventional device in that a peak voltage (6 to 8 (KV)), and then a direct current (DC) voltage (3 to 4 (KV)), are generated in a secondary coil, and both are supplied to the ignition plug when the primary coil current starts to flow. Because of these unnecessary voltages, the discharge of the ignition plug is started before the predetermined ignition timing, and thus a problem occurs in that the ignition timing becomes too advanced.

SUMMARY OF THE INVENTION

The object of the present invention is to provide an ignition device of the AC continuous discharge type which enables a reduction of the voltage generated in the secondary coil when the primary coil current at each ignition timing starts to flow, and thus prevents a too advanced ignition timing.

In accordance with the present invention, there is provided an ignition device for an internal combustion engine including: a direct current power source (1) providing a direct current voltage; an ignition coil (11) having first (13), second (14), and third (20) primary coils, and a secondary coil (15); a first switching element (7) forming a first closed circuit together with the direct current power source (1) and the first primary coil (13); a second switching element (8) forming a second closed circuit together with the direct current power source (1) and the second primary coil (14); a reverse current-flow preventive element (9, 10) defining a current-flow direction in one direction in the first and second closed circuits; current detection elements (22, 24) for detecting current-flow in the first and second closed circuits; a third switching element (52) forming a third closed circuit together with the direct current power source (1) and the first (13) and third (20) primary coils; an ignition command signal generating circuit (20*a*) for repeatedly producing, at every ignition timing, a first ignition command signal ($S_1$) to command a turning ON of the third closed circuit, and a second ignition command signal ($S_2$) to command a turning ON of the first and second closed circuits after a delay of a predetermined time from the timing of the first ignition command signal; and a control circuit (40) for causing the first and second switching elements (7, 8) to push-pull operate in such a way that when the second ignition command signal ($S_2$) is input and a current flow in one side of the first and second closed circuits reaches a predetermined value, a first signal cutting the current flow in one side of the first and second closed circuits is applied to one side of the first and second switching elements (7, 8), and then a second signal starting the other current flow is applied to the other side of the first and second switching elements.

DESCRIPTION OF THE PREFERRED EMBODIMENTS

An ignition device for an internal combustion engine will be explained in detail with reference to the accompanying drawings.

First, however, an explanation will be given of the structure of the internal combustion engine and the peripheral devices to which the present invention is applied.

Figure 2:
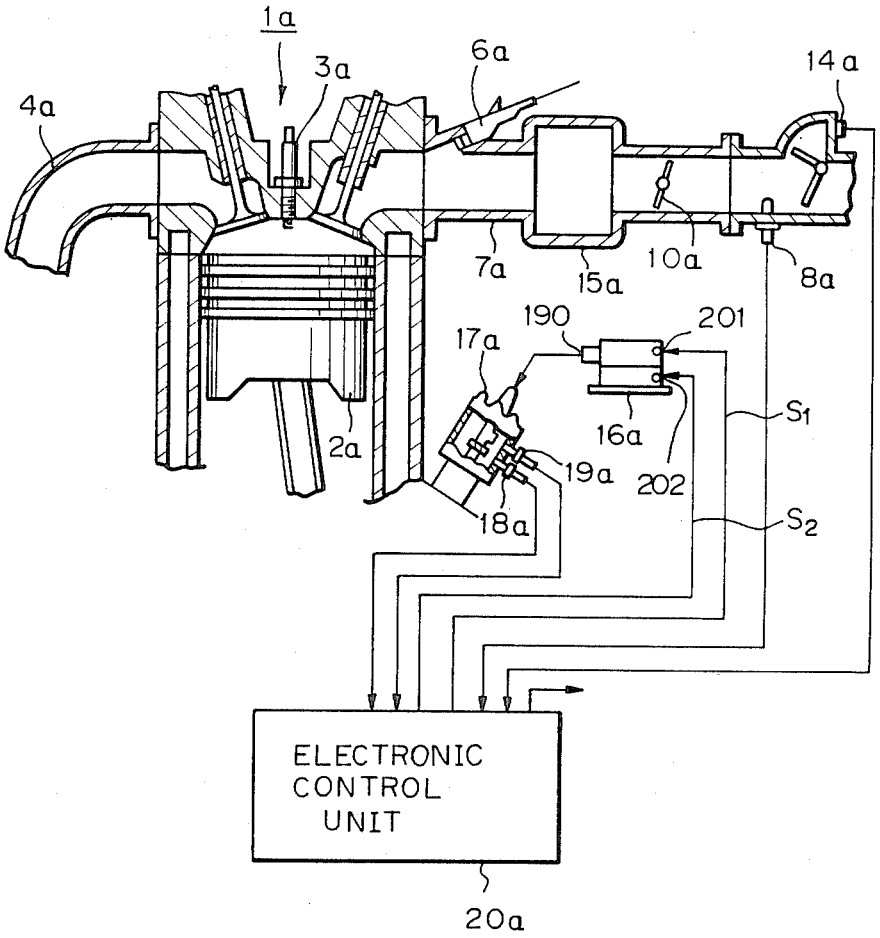
FIG. 2 is a schematic sectional view of an internal combustion engine and peripheral devices to which the present invention is applied.

Referring to FIG. 2, reference 1*a* represents an engine body, 2*a* a piston, 3*a* an ignition plug, 4*a* an exhaust manifold, 6*a* a fuel injection valve for injecting fuel to an intake air passage in the engine body 1*a*, 7*a* an intake manifold, 8*a* a sensor for detecting a temperature of an intake air sent to the engine body 1*a*, 10*a* a throttle valve, 14*a* an air flow meter for measuring an intake air volume, and 15*a* a surge tank for absorbing ripple components contained in the intake air.

Reference number 16*a* represents an ignition device outputting a high output voltage necessary for the ignition, 17*a* a distributor coupled to a crank shaft (not shown) of the engine body 1*a*, for supplying a high output voltage generated in the ignition device 16*a* to an ignition plug of each cylinder, 18*a* a rotational angle sensor mounted in the distributor, for outputting twenty four pulse signals per one rotation of the distributor 17a (i.e., per two rotations of the crank shaft), 19a a cylinder discriminating sensor for outputting one pulse signal per one rotation of the distributor 17a, and 20a an electronic control unit (ECU).

Wires are provided between the ECU 20a and the ignition device 16a to transmit first and second ignition command signals from the ECU to input terminals 201 and 202 of the ignition device 16a.

A wire is also provided between an output terminal 190 of the ignition device 16a and the distributor 17a, to supply a high output voltage from the ignition device 16a to the distributor 17a.

Figure 1:
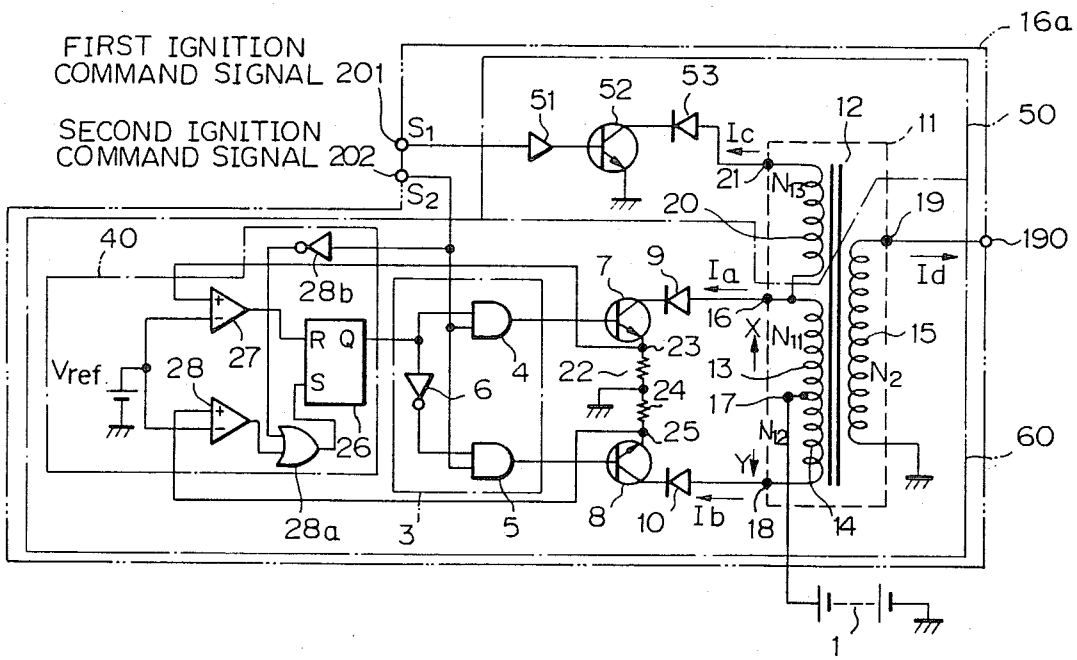
FIG. 1 is a circuit diagram of an ignition device according to a first embodiment of the present invention.

Referring to FIG. 1, the ignition device 16a of the first embodiment according to the present invention is constituted by a supplementary energized circuit 50 and an AC continuous discharge ignition circuit 60. The AC continuous discharge ignition circuit 60 is similar to the conventional circuit shown in U.S. Pat. No. 4,356,807.

The circuit structure of the AC continuous discharge ignition circuit 60 will be explained in detail below. In FIG. 1, reference number 1 represents a battery as a direct current (DC) power source mounted in a car, and 3 a logic circuit constituted by two AND gates 4 and 5 and an inverter 6. A second ignition command signal $S_2$ and an output signal of a judging circuit 40 are input to an AND gate 4. Note, the output signal of the judging circuit 40 is passed through the AND gate 4 when the second ignition command signal $S_2$ is "1" level, and an "0" level output signal of the judging circuit 40 is passed through the AND gate 4 when the signal $S_2$ is "0" level. In an AND gate 5, an inverted output signal can be passed through the AND gate 5 when the signal $S_2$ is "1" level, and an "0" level output signal is passed through the AND gate 5 when the signal $S_2$ is "0" level.

Reference numbers 7 and 8 represent power transistors used as first and second switching elements for performing push-pull operations based on the outputs of the AND gates 4 and 5. A base of the power transistor 7 is connected to an output terminal of the AND gate 4, and a base of the other power transistor 8 is connected to an output terminal of the AND gate 5. Collectors of the transistors 7 and 8 are connected to a terminal 16 of the first primary coil 13 and a terminal 18 of the second primary coil 14 through diodes 9 and 10. These diodes are used as a reverse current flow preventive element, the collectors of the transistors 7 and 8 are connected to the cathodes of the diodes 9 and 10. The emitters of the transistors 7 and 8 are connected to a minus terminal of the DC power source 1 as a common terminal through current detection resistors 22 and 24 having very low resistances. These current detection resistors 22 and 24 are used as a current detection element.

In the ignition coil 11, the first and second primary coils 13 and 14 have an approximately equal number of turns, and the turn ratio between these primary coils 13 and 14 and the secondary coil 15 is set to approximately 300. These primary coils 13 and 14 and the secondary coil 15 are magnetically coupled together through the core 12. The voltages generated in the primary coils 13 and 14 are boosted by the secondary coil 15. The terminals 16 and 18 of the primary coils are connected to the anodes of the diodes 9 and 10 respectively. The intermediate terminal 17 thereof is connected to the positive (+) terminal of the DC power source 1.

An output terminal 19 of the secondary coil 15 is connected to the terminal 190 and connected to the distributor 17a through the terminal 190.

The judging circuit 40 detects voltage drops across the current detection resistors 22 and 24 and judges the magnitudes of the primary currents Ia and Ib of the ignition coil 11.

In the judging circuit 40, a dropped voltage across the resistor 22 is applied to a positive input terminal (+) of a comparator 27, and a predetermined reference voltage $V_{ref}$ is applied to a negative input terminal (−) of the comparator 27. The comparator 27 compares the dropped voltage with the predetermined reference voltage. When the former is higher than the latter, the comparator 27 outputs a "1" level signal, and when the former is lower than the latter, the comparator 27 outputs an "0" level signal. In the comparator 28, a dropped voltage across the resistor 24 is applied to a positive input terminal (+) of the comparator 28, and the predetermined reference voltage $V_{ref}$ is applied to a negative input terminal (−) thereof. When the former is higher than the latter, the comparator 28 outputs a "1" level signal, and when the former is lower than the latter, the comparator 28 outputs an "0" level signal. An output terminal of the comparator 28 is connected to one input terminal of an OR gate 28a, and a second ignition command signal is applied to the other input terminal of the OR gate 28a through an inverter 28b. A terminal S of a set-reset (RS) flip-flop circuit 26 is a "set" input terminal, a terminal R is a "reset" input terminal, and a terminal Q is an output terminal thereof. The terminal S of the flip-flop circuit 26 is connected to the output terminal of the OR gate 28a, and the terminal R is connected to the output terminal of the comparator 27. When the comparator 27 outputs a "1" level signal, the terminal Q of the flip-flop circuit 26 provides an "0" level signal. When the comparator 28 outputs a "1" level, the terminal Q provides a "1" level signal.

Next, an explanation will be given of the supplementary energized circuit 50. Reference number 51 represents a drive circuit for amplifying the first ignition command signal input to the terminal 201. An output of this circuit 51 is applied to a power transistor 52 as a third switching element. A collector of the transistor 52 is connected to a terminal 21 of a third primary coil 20 of the ignition coil 11 through a diode 53, and the other terminal of the third primary coil 20 is connected in common to the terminal 16 of the first primary coil 13. The turn ratio between the number of turns adding the third primary coil 20 to the first primary coil 13 and the number of turns of the secondary coil 15 is set to approximately 100. The third primary coil 20 is magnetically coupled with the secondary coil 15 through the core 15, the voltages produced by the first and third primary coil 13 and 20 are boosted by the secondary coil 15.

Figure 3:
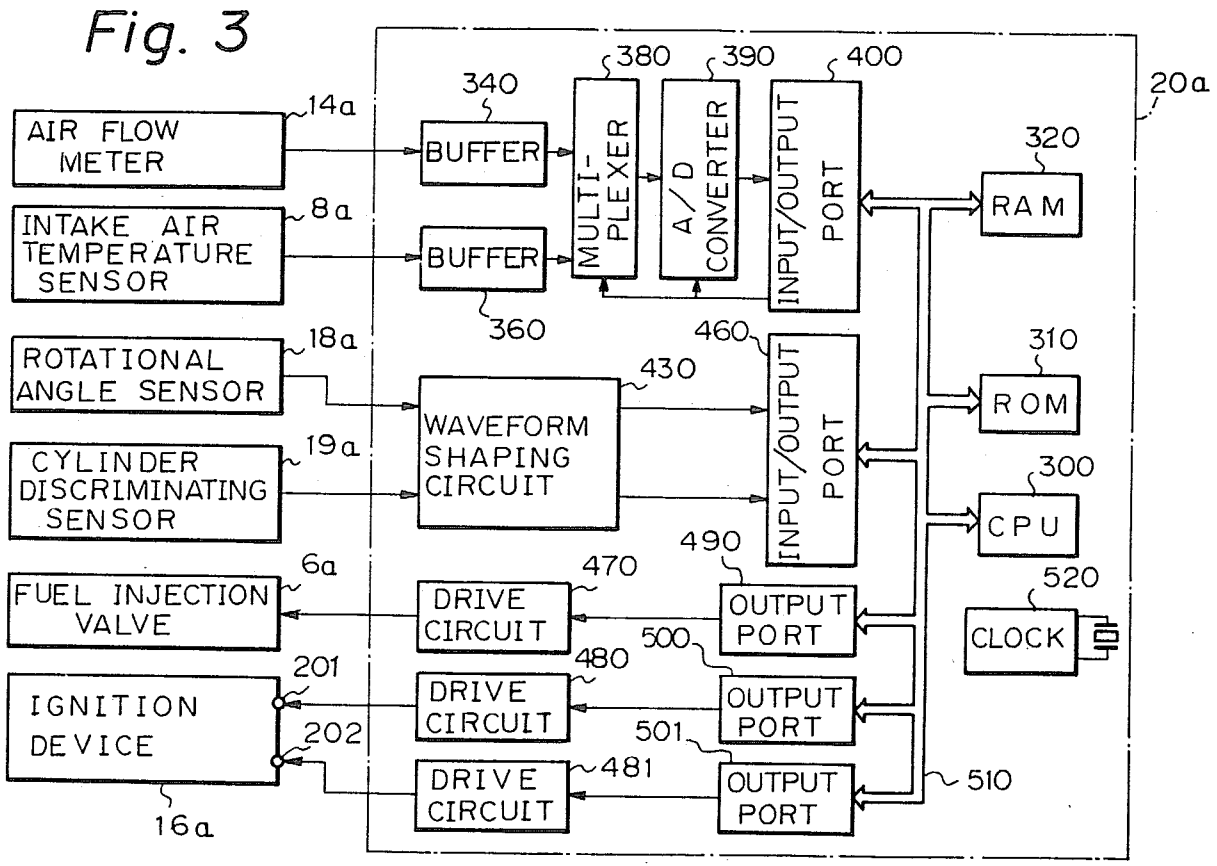
FIG. 3 is a schematic block diagram of an electronic control unit shown in FIG. 2.

Referring to FIG. 3, reference number 300 represents a central processing unit (CPU) for calculating the data provided from sensors, based on a control program, and for outputting control data to control the ignition device 16a and the other devices. Reference 310 is a read only memory (ROM) for storing the control program and various fixed data, 320 a random access memory (RAM) for temporarily reading and writing necessary data for calculation control and the data input to the ECU 20a, 340 and 360 buffers for the output signals of the sensors 8a and 14a, 380 a multiplex for selectively outputting the output signals of the sensors 8a and 14a to the CPU 300, 390 an analog-to-digital (A/D) converter for converting an analog signal to digital codes, 400 an input-output port for transmitting sensor signals to the CPU 300 through the buffers 340 and 360, the multiplexer 380, and the A/D converter 390, and for outputting control signals transmitted from the CPU 300 to the multiplexer 380 and the A/D converter 390.

Reference number 430 represents a waveform shaping circuit for shaping waveforms of output signals of the rotational angle sensor 18*a* and the cylinder discriminating sensor 19*a*, and shaped signals are transmitted to the CPU 300 through the input-output port 460.

Reference numbers 470, 480, and 481 represent drive circuits for driving the fuel injector 6*a* and the ignition device 16*a* based on the control signal transmitted from the CPU 300 through the output ports 490, 500, and 501. Reference 510 is a bus line used as a passage for various signals and data, and 520 a clock circuit for supplying clock signals used for determining the control timings of the CPU 300, the ROM 310, and the RAM 320.

Figure 4:
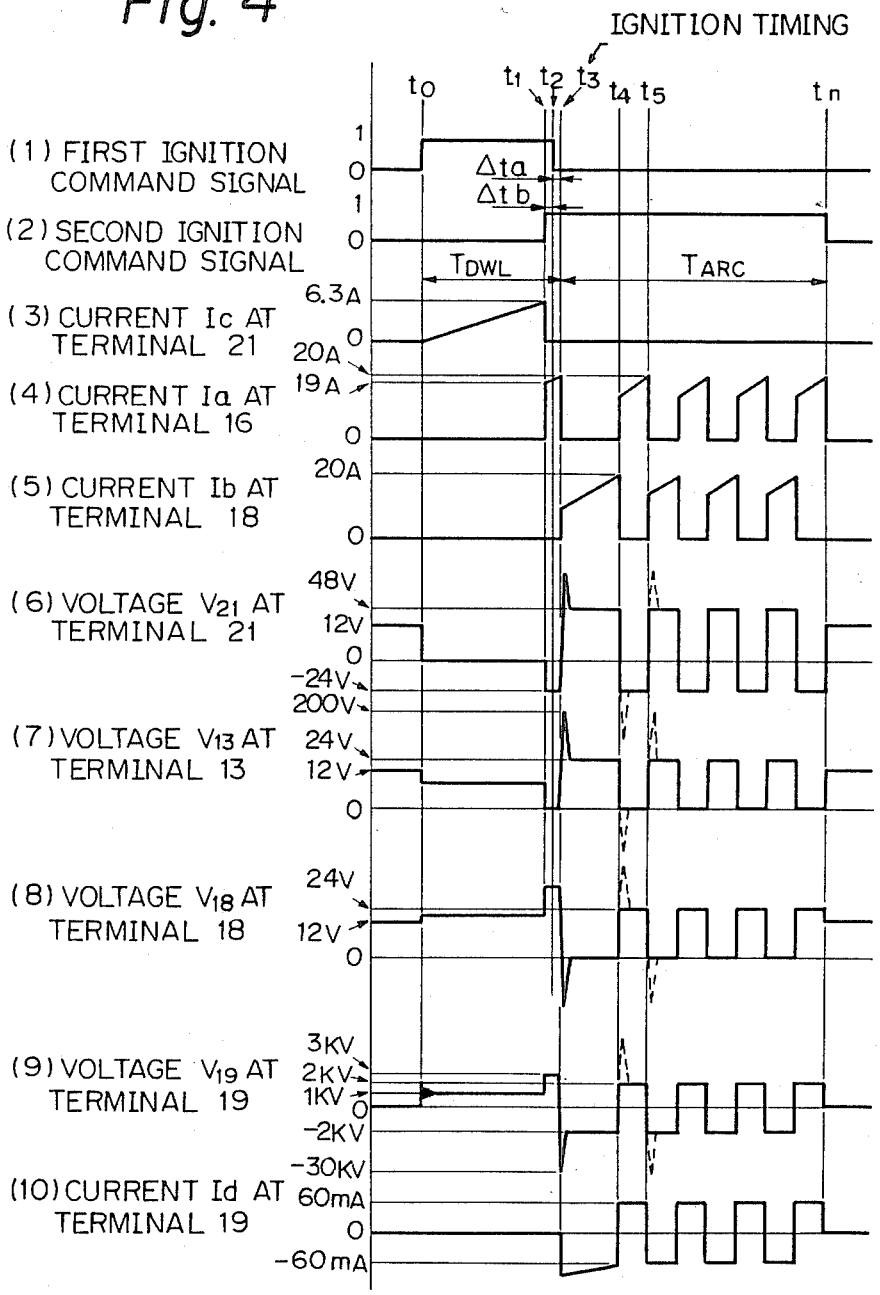
FIG. 4 shows waveforms for explaining the operation of the circuit shown in FIG. 1.

Referring to FIG. 4, the first and second ignition command signals $S_1$ and $S_2$ are input to the terminals 201 and 202 of the ignition device 16*a* from the ECU 20*a* in synchronization with the rotation of the crank shaft during operation of the internal combustion engine. These command signals $S_1$ and $S_2$ are shown by the timings (1) and (2), and these timings are determined by the ECU 20*a*.

The duration of the first ignition command signal $S_1$ is equivalent to a known "dwell time" (indicated by $T_{DWL}$) of the ignition device for the internal combustion engine, and the second ignition command signal $S_2$ is equivalent to the discharge duration range $T_{ARC}$ of the ignition plug. The time $t_3$ indicates the ignition timing.

The supplementary energized circuit 50 in the ignition device 16*a* operates only during the period from time $t_0$ to time $t_1$, and the magnetic energy is stored in the core 12 through the third primary coil 20. The AC continuous discharge ignition circuit 60 starts to operate at the time $t_1$ and the high output voltage is produced across the secondary coil 15 just at the time $t_3$. This high voltage becomes a breakdown voltage and the breakdown of the ignition plug 3*a* is performed by this high voltage. Accordingly, the time $t_3$ becomes the ignition timing. After the time $t_3$, as explained in the specification of U.S. Pat. No. 4,356,807, the transistors 7 and 8 operate as a push-pull circuit, and then an AC high voltage is generated across the secondary coil 15 and an AC continuous discharge is performed in the ignition plug 3*a*.

The operations of the ignition device will be explained in detail with reference to FIG. 4.

The first ignition command signal $S_1$ changes from "0" level to "1" level at the time $t_0$, this "1" level signal is input to the terminal 201 and amplified by the drive circuit 51 and applied to the base of the transistor 52. The transistor 52 is turned ON by this high level signal. When the transistor 52 is turned ON, the voltage $V_{21}$ at the terminal 21 of the third primary coil 20 is dropped from the voltage of the battery (12 (V)) to the ground voltage (0 (V)). Accordingly, current can flow along a route such as; the positive terminal of the battery 1→the intermediate terminal 17 of the first and second primary coils→the first primary coil 13→the third primary coil 20→the terminal 21→the diode 53→the collector of the transistor 52→the emitter of the transistor 52→the negative terminal of the battery 1. This current is equal to the third primary coil current $I_c$ shown in (3), and this current $I_c$ gradually and linearly increases with the lapse of time from $t_0$ to $t_1$.

When the transistor 52 is turned ON at the time $t_0$, since the battery voltage (12 (V)) is applied between the terminal 17 and the terminal 21, the peak voltage (approximately 2 (KV)) shown in (9) is applied to the terminal 19 of the secondary coil 15. After a short time, this peak voltage is dropped to the DC voltage (approximately 1 (KV)). The magnitudes of these voltages depend on the turn ratio of the primary coil (first and third) and the secondary coil 15. That is, the turn ratio between the number of turns ($N_{13}+N_{11}$) adding the number of turns $N_{13}$ of the third primary coil 20 to the number of turns $N_{11}$ of the first primary coil 13 and the number of turns $N_2$ of the secondary coil 15, is set to approximately 100, thus the voltage obtained by multiplying the battery voltage by the turn ratio is produced at the secondary coil 15. Accordingly, this produced voltage is given by 12 (V)×100≈1 (KV). However, as shown in (9), the double voltage of the above voltage (1 (KV)) transiently occurred at the time $t_0$ when the battery voltage is applied to the primary coils 13 and 20.

The second ignition command signal $S_2$ changes from "0" level to "1" level at the time $t_1$, and this signal $S_2$ is input to the terminal 202, then the AC continuous discharge ignition circuit 60 starts to operate. The signal $S_2$ is also input to the terminal S of the flip-flop circuit 26 through the inverter 28*b* and the OR gate 28*a*. When the signal $S_2$ is "0" level, the output of the AND gate 4 becomes "1" level, since the terminal Q is previously set to "1" level, and the transistor 7 is turned ON. At this time $t_1$, the third primary coil current $I_c$ reaches the predetermined current value (6.3 (A)) as shown in (3). At this timing $t_1$, the transistor 7 is turned ON, as mentioned above, the voltage $V_{13}$ of the terminal 16 is dropped to 0 (V), as shown in (7), and the voltage $V_{21}$ of the terminal 21 is dropped to −24 (V) as shown in (6). As a result, the diode 53 is changed to a reverse biased state, and the current $I_c$ changes from 6.3 (A) to 0 (A) as shown in (3). Corresponding to this rapid change of the current $I_c$, the current Ia flowing at the terminal 16 of the first primary coil 13 suddenly changes from 19 (A) to 0 (A), as shown in (4).

This is because, since the number of turns of the first primary coil 13 is $N_{11}$ and that of the third primary coil 20 is $N_{13}$, the following formula is given before and after time $t_1$ based on the Law of Ampere/turn (AT).

$$(N_{11}+N_{13})\times I_c=N_{11}\times I_a \quad (1)$$

Since the turn ratio between the number of turns $N_{13}$ and the number of turns $N_{11}$ is set at 2 to 1, $$N_{13}/N_{11}=2 \quad (2)$$

The following formula is then obtained from the above formulas (1) and (2), $$I_a/I_c=3 \quad (3)$$

Accordingly, since the current $I_c$ just before the time $t_1$ is 6.3 (A), the current $I_a$ just after the time $t_1$ becomes approximately 19 (A) (6.3 (A)×3) based on the formula (3). When the turn ratio between the number of turns of the primary coil $N_{11}$ and the number of turns of the secondary coil $N_2$ is set to approximately 300, and just after the time $t_1$, the battery voltage (12 (V)) is applied to the primary coil 13, and the voltage 3 (KV) (12 (V)×300) is produced at the secondary coil 15. Accordingly, the voltage $V_{19}$ of the terminal of the secondary coil 15 is suddenly changed from 1 (KV) to 3 (KV) at the time $t_1$, as shown in (9).

At the time $t_2$ just after the time $t_1$, the signal $S_1$ changes from "1" level to "0" level as shown in (1), and corresponding to this change, the transistor 52 is turned OFF and stops the operation of the supplementary energized circuit 50.

At the time $t_3$, the transistor 7 of the AC continuous discharge ignition circuit 60 is turned ON, and the current $I_a$ of the first primary coil 13 reaches 20 (A). In this case, the reference voltage $V_{ref}$ of the judging circuit 40 is set to a voltage equivalent to the voltage drop produced across the current detection resistor 22 when the current $I_a$ is 20 (A). Accordingly, after passing the time $t_3$, since the voltage drop across the current detection resistor 22 corresponding to the current $I_a$ is higher than the reference voltage $V_{ref}$, and the comparator 27 outputs a pulse signal at the time $t_3$. Since this pulse signal is input to the terminal R of the flip-flop circuit 26, the output at the terminal Q changes from "1" level to "0" level and the state of the transistor 7 is changed from ON to OFF, and thus the current Ia is rapidly reduced just after indicating 20 (A), as shown by (4).

Consequently, in the first primary coil 13, a counter electromotive force is produced in the "X" direction, as shown by an arrow in FIG. 1, and a peak voltage of approximately 200 (V) is produced, as shown in (7). This peak voltage is boosted based on the turn ratio (approximately 300) between the number of turns of the first primary coil 13 and that of the secondary coil 15. Accordingly, a high voltage (approximately 200 (V)×300=60 (KV)) is theoretically obtained. However, in actuality, because the core 12 suffers from an iron loss and a coupling coefficient is smaller than the value "1", a negative peak voltage (approximately, −30 (KV)) is produced at the terminal 19 of the secondary coil 15, as shown in (9). This peak voltage is divided by the distributor 17*a* through the terminal 190, and then sent to the ignition plug 3*a*. The ignition plug 3*a* starts to break down and the discharge is started by this divided peak voltage. At the same time as this discharge occurs, a current $I_d$ at the terminal 19 of the secondary coil 15 starts to flow under the waveform shown in (10).

Meanwhile, since the output at the terminal Q of the flip-flop circuit 26 becomes "0" level, the transistor 8 and the diode 10 are turned ON after the time $t_3$, and then the currents $I_a$, $I_c$ and the reverse current $I_b$ start to flow in the second primary coil 14, as shown in (5). Because of these currents, after the ignition plug 3*a* starts to discharge at the time $t_3$, a constant voltage (approximately −2 (KV)) is produced and the discharge current (approximately −60 (mA)) can flow to the terminal 19, as shown in (9) and (10). The current $I_b$ of the second primary coil 14 is gradually increased with the lapse of time.

When the current $I_b$ of the second primary coil 14 reaches 20 (A) at the time $t_4$, since the resistance value of the current detection resistor 24 is set to correspond to the voltage drop of the current detection resistor 24 is equal to the reference voltage $V_{ref}$, the voltage drop of the current detection resistor 24 corresponding to the current $I_b$ is higher than the reference voltage after the time $t_4$, and the comparator 28 then outputs the pulse signal at the time $t_4$. Since this pulse signal is input to the terminal S of the flip-flop circuit 26, the output at the terminal Q of the flip-flop circuit 26 changes from "0" level to "1" level at the time $t_4$, and the state of the transistor 8 is changed from ON to OFF, and accordingly, the current $I_b$ of the second primary coil 14 is rapidly reduced after indicating a maximum 20 (A), as shown in (5). Consequently, a counter electromotive force is produced in the "Y" direction in the second primary coil 14, as shown by the arrow in FIG. 1, and if the discharge of the ignition plug 3*a* is stopped at the time $t_4$, a positive peak voltage is produced at the terminal 19 of the secondary coil 15, as shown by a dotted line in (9), and thus discharge at the ignition plug 3*a* is restarted. If the discharge of the ignition plug 3*a* is maintained at the time $t_4$, the above positive voltage is not produced at the terminal 19, and the voltage at the terminal 19 is changed from the negative voltage (approximately −2 (KV)) to the positive voltage (approximately +2 (KV)), as shown by the solid line in (9).

After the time $t_4$, the transistor 7 and the diode 9 are turned ON, and the current $I_a$ of the first primary coil 13 then flows as shown in (4), and thus the discharge of the ignition plug 3*a* can be maintained by this current $I_a$ flowing through the ignition coil 11. After the time $t_4$, the current $I_a$ of the first primary coil 13 is gradually increased with the lapse of time.

When the current Ia of the first primary coil 13 reaches 20 (A) at the time $t_5$, the comparator 27 starts to operate and outputs a pulse signal, and the level of the terminal Q of the flip-flop 26 then changes from "1" to "0". Corresponding to this change, the output voltage of the secondary coil 15 changes from the positive voltage (+2 (KV)) to the negative voltage (−2 (KV)), as shown in (9), and the discharge of the ignition plug 3*a* is maintained. After the time $t_5$, the above explained operations are repeated, as shown in FIG. 4, and thus the AC continuous discharge of the ignition plug 3*a* can be carried out while the second ignition command signal $S_2$ is at the "1" level.

As explained above, the ignition device 16*a* having the supplementary energized circuit 50 and the AC continuous discharge ignition circuit 60 can solve the conventional problem in which the peak voltage reaching 6 to 9 (KV) is produced and then the DC voltage reaching 3 (KV) is sequentially produced in the secondary coil when the AC continuous discharge ignition circuit 60 is turned ON, and thus a too advanced ignition is produced in the ignition plug 3*a*. That is, in the present invention, both the peak voltage and DC voltage can be reduced to 2 (KV) (peak voltage) and 1 (KV) (DC voltage) by adding the supplementary energized circuit 50.

Next, the procedure for generating the first and second ignition command signal will be explained in detail with reference to FIG. 5.

Figure 5:
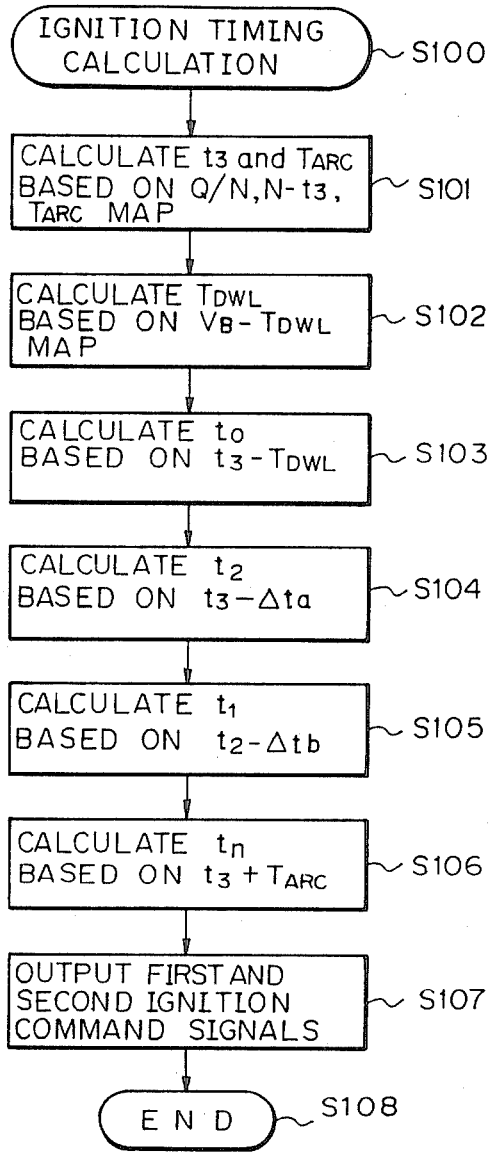
FIG. 5 is a flowchart for explaining the control program of the electronic control circuit shown in FIG. 3.

Referring to FIG. 5, this flow chart denotes the control program (S100) for the calculation of the ignition timing. This program is interleaved with the main program (not shown) which processes the fuel injection control and the like based on the predetermined interleaved timing.

In step S101, the calculations of the ignition timing $t_3$ and the discharge duration $T_{ARC}$ are started based on the ratio Q/N between the intake air volume and the engine rotational speed, and the engine rotational speed N.

The relationship between Q/N, N and $t_3$, $T_{ARC}$ are stored in the ROM 310 as a two dimensional map (not shown), and the values $t_3$ and $T_{ARC}$ corresponding to the values Q/N and N are read out from the ROM 310 by the CPU 300. The duration $T_{ARC}$ stored in the ROM 310 is set for a long time (for example, 5 to 10 msec), in an idling and light load condition, thus improving the ignition, and is set for a short time (for example, 1 to 2 msec) in a high rotational speed and heavy load condition.

The intake air volume is calculated by the CPU 300, the ROM 310, and the RAM 320 based on the signals from the airflow meter 14*a* and the intake air temperature sensor 8*a*, and the engine rotational speed N is calculated by the CPU 300 based on signals from the rotational angle sensor 18*a*.

Figure 6:
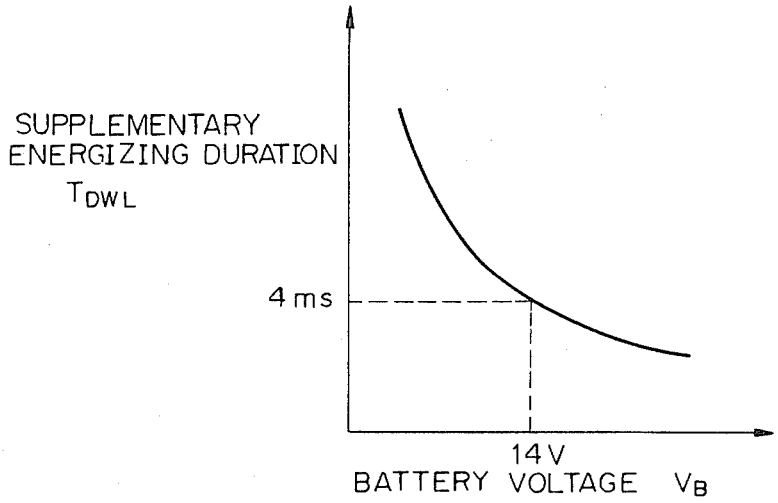
FIG. 6 is a characteristic curve for explaining the relationship between a battery voltage and a supplementary energizing duration.

In step S102, the supplementary energizing duration $T_{DWL}$ is calculated based on the battery voltage. The duration $T_{DWL}$ denotes the time from which the current $I_c$ starts to energize at the time $t_0$ until it reaches to approximately 6.3 (A). This duration $T_{DWL}$ is shown by the relationship of an inverse proportion to the battery voltage $V_B$ as shown in FIG. 6. This relationship is stored in the ROM 310 as a one-dimension map, and the duration $T_{DWL}$ corresponding to the battery voltage $V_B$ is read out from the ROM 310 by the CPU 300.

In step S103, the time $t_0$ of the first ignition command signal is calculated based on the time $t_3$ and the supplementary energizing duration $T_{DWL}$. In this case, the time $t_0$ is obtained by subtracting the duration $T_{DWL}$ from the time $t_3$.

In step S104, the time $t_2$ of the first ignition command signal is calculated based on the time $t_3$ and a very short duration $\Delta t_a$. In this case, the time $t_2$ is obtained by subtracting the duration $\Delta t_a$ from the time $t_3$.

In step S105, the time $t_1$ of the second ignition command signal is calculated based on the time $t_2$ and a very short duration $\Delta t_b$. In this case, the time $t_1$ is obtained by subtracting the duration $\Delta t_b$ from the time $t_2$. Where, the very short duration $\Delta t_a$ signifies the period between the time $t_2$ and the time $t_3$, and the duration $\Delta t_b$ the period between the time $t_1$ and the time $t_2$.

The reasons for providing the durations $\Delta t_a$ and $\Delta t_b$ will be explained below. That is, in FIG. 4 (1), (2), (3), and (4), first, the signal $S_2$ is changed from "0" level to "1" level at the time $t_1$, and thus the current $I_a$ at the terminal 16 of the primary coil starts to flow. Simultaneously, the current $I_c$ at the terminal 21 of the third primary coil is stopped. Next, the signal $S_1$ is changed from "1" level to "0" level, and the transistor 52 is turned OFF at the time $t_2$. Following these steps, the current $I_a$ reaches 20 (A) at the time $t_3$, the transistor 7 is turned ON, and the discharge of the ignition plug is started. Therefore, the durations $\Delta t_a$ and $\Delta t_b$ are provided in order to define the above procedures and enable a precise ignition timing.

In step S106, the end time $t_n$ of the second ignition command signal is calculated by adding the time $t_3$ to the duration $T_{ARC}$.

In step S107, the first ignition command signal $S_1$, which is "1" level from the time $t_0$ calculated in step S103 to the time $t_2$ calculated in step S104, and is "0" level in another timing, is output. The second ignition command signal $S_2$, which is "1" level from the time $t_1$ calculated in step S105 to the end time $t_n$ calculated in step S106, and is "0" level in another timing, is also output.

After the first and second ignition command signals are output, this procedure is finished as shown in step S108.

Figure 7:
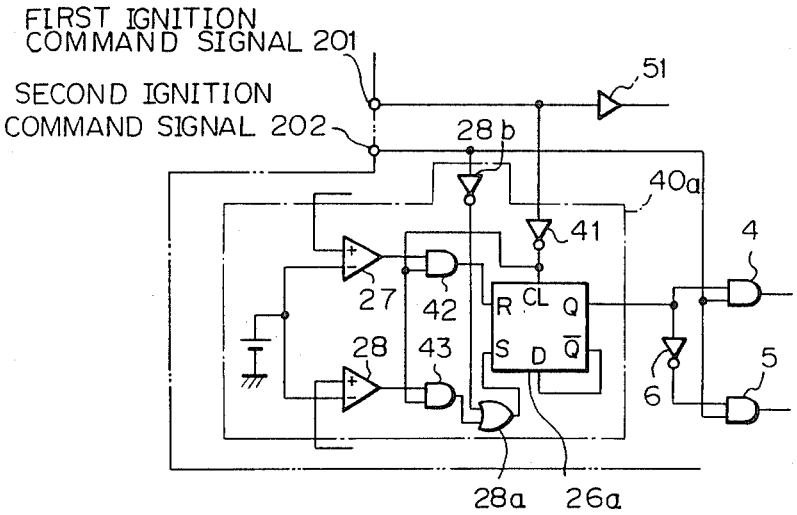
FIG. 7 is a partial circuit diagram of an ignition device according to a second embodiment of the present invention.
Figure 8:
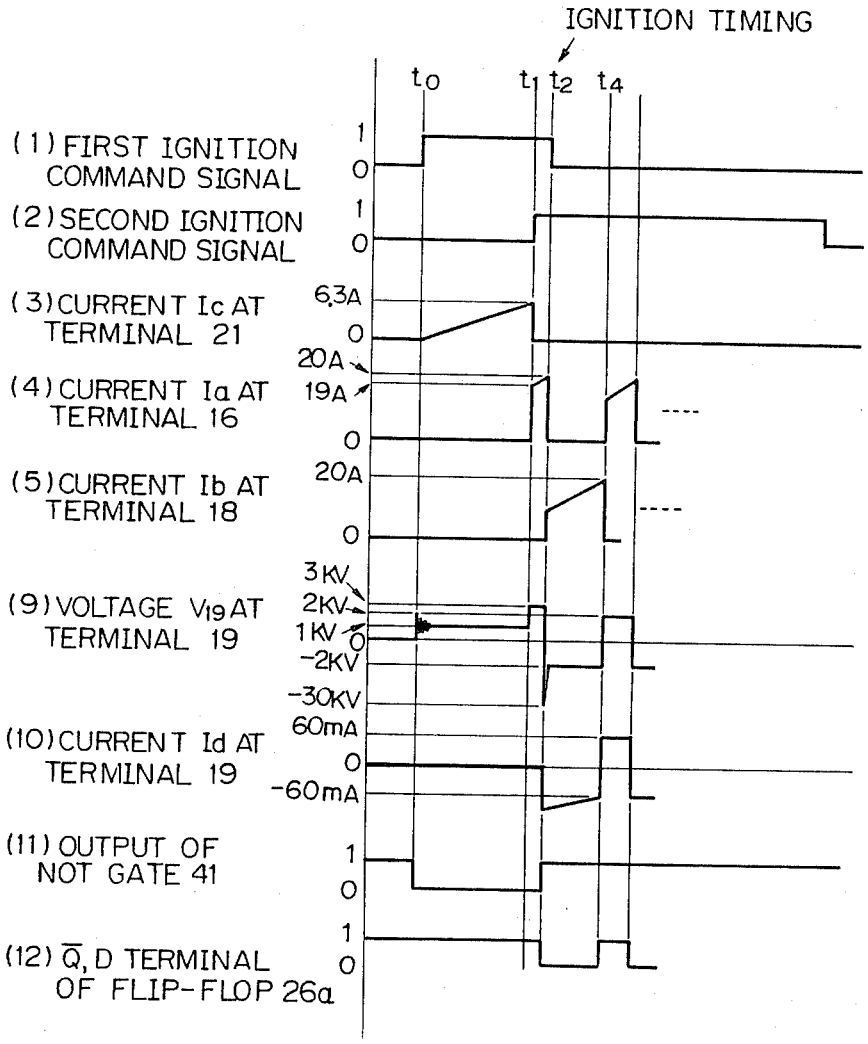
FIG. 8 shows waveforms for explaining the operation of the circuit shown in FIG. 7.

Referring to FIG. 7, the feature of this embodiment lies in a change of the ignition timing as shown in FIG. 8. That is, the time $t_2$ is set to the ignition timing. This time $t_2$ indicates the time at which the level of the first ignition command signal changes from "1" to "0". The circuit shown in FIG. 7 is modified from the first embodiment in FIG. 1 so as to produce this ignition timing.

As shown by the new judging circuit 40*a*, AND gates 42 and 43 and a NOT gate 41 are added to the judging circuit 40 in FIG. 1, and the set/reset flip-flop circuit 26 in FIG. 1 is changed to a D-type flip-flop circuit 26*a*. In this case, the AND gate 42 is connected between the output terminal of the comparator 27 and the reset input terminal R, and the AND gate 43 is connected between the output terminal of the comparator 28 and the set input terminal S through the OR gate 28*a*. An inverted first ignition command signal by the inverter 41 is input to the AND gates 42 and 43, and the AND gates 42 and 43 are opened or closed by this inverted signal.

When the first ignition command signal is "1" level, the output signals of the comparators 27 and 28 are not transferred to the flip-flop circuit 26*a*. In a contrary case, the output signals are transferred to the flip-flop circuit 26*a*. Moreover, since the inverted signal by the NOT gate 41 is also input to a clock terminal CL of the flip-flop circuit 26*a* and an inverted output terminal $\overline{Q}$ is connected to a data input terminal D, the output terminal Q is inverted when the first ignition command signal changes from "1" level to "0" level.

Referring to FIG. 8, the same wave-forms as that of FIG. 4 are shown from the time $t_0$ to the time $t_1$.

The current $I_a$ indicating 19 amperes (A) at the terminal 16 of the primary coil is increased with the lapse of time from the time $t_1$. When the first ignition command signal is changed from "1" level to "0" level at the time $t_2$ as shown by (1), this signal is inverted from "0" level to "1" level by the inverter 41 as shown in (11) and input to the clock terminal CL as a leading signal.

Accordingly, the level of the output terminal Q of the flip-flop circuit 26*a* is changed from "1" level to "0" level as shown in (1). The change of the level is transferred to the transistors 7 and 8 through the AND gates 4 and 5, a high voltage (approximately −30 (KV)) is produced at the terminal 19 of the secondary coil 15 at the time $t_2$, as shown in (9), and the discharge of the ignition coil 3*a* is started by this negative high voltage.

In this case, if the current $I_a$ at the terminal 16 of the primary coil exceeds 20 (A) from the time $t_1$ to the time $t_2$ and the comparator 27 outputs a "1" level signal, this "1" level signal can not pass the AND gate 42, and thus can not reset the flip-flop circuit 26*a* because the output signal of the NOT gate 41 is "0" level from the time $t_1$ to the time $t_2$, as shown in (11). Accordingly, the switching operation of the transistors 7 and 8 is not carried out before the time $t_2$ and always can perform the switching operation at the time $t_2$ as shown in (4) and (5).

One of differences between the first embodiment and the second embodiment lies in the ignition timing. That is, in the first embodiment, the ignition timing occurs at the time $t_3$, and in the second embodiment, the ignition timing occurs at the time $t_2$. The advantage of the second embodiment is that it makes it possible to precisely determine the time $t_2$, because this time $t_2$ is given by the trailing edge of the first ignition command signal. In the first embodiment shown in FIG. 4, the time $t_3$ is determined by adding the time $t_2$ to the very short duration $\Delta t_a$, and this time $t_3$ is also the time at which the current $I_a$ at the terminal 16 of the primary coil reaches 20 (A). However, this time at which the current reaches 20 (A) varies under different conditions.

Figure 9:
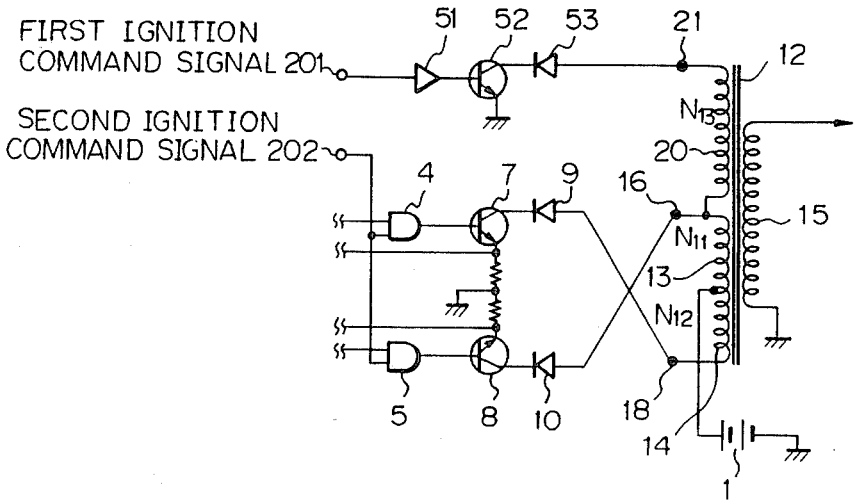
FIG. 9 is a partial circuit diagram of an ignition device according to a third embodiment of the present invention.
Figure 10:
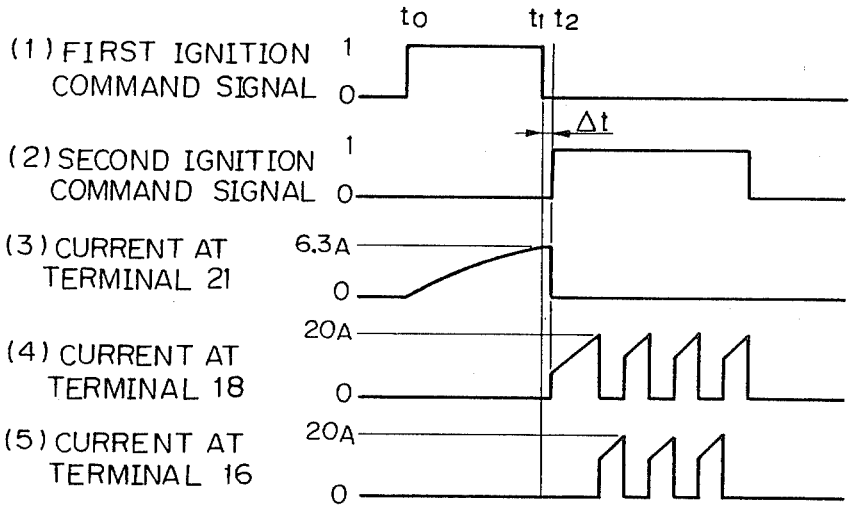
FIG. 10 shows waveforms for explaining the operation of the circuit shown in FIG. 9.

Referring to FIG. 9, the differences between the first embodiment and this embodiment lie in the connections between the power transistors 7, 8 and the primary coils 13, 14. That is, the terminal 16 of the first primary coil 13 is connected to the anode of the diode 10, and the terminal 18 of the second primary coil 14 is connected to the anode of the diode 9. In FIG. 10, the current flowing in the first and third primary coils 13 and 20 is cut as shown in (3), and thus a high voltage is produced in the secondary coil 15 and the discharge of the ignition coil is started. Simultaneously, the current starts to flow in the reverse direction from the second primary coil 14 to the first and third primary coils 13 and 20 as shown in (4). This reverse current induces a new current in the secondary coil 15 and this induced current is added to the secondary coil current as the discharge current. The duration $\Delta t$ between the time $t_1$ and the time $t_2$ may be theoretically set to approximately zero. For example, when a high speed transistor in which a lag time at the cutting of a transistor is negligible is used, this duration $\Delta t$ also becomes negligible. However, in actuality, the duration $\Delta t$ in this embodiment is set to approximately 40 $\mu$s, based on the switching lag time of the transistor 52. The current flowing in the first primary coil 13 is shown in (5). After this time $t_2$, the current alternately flows in the first and second primary coils 13 and 14 when the second ignition command signal is at the "1" level.

Figure 11:
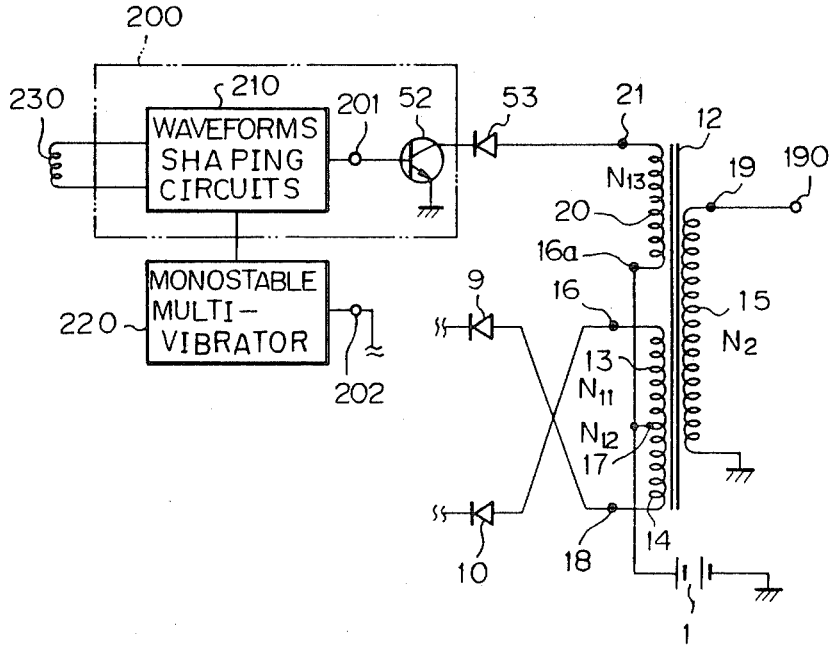
FIG. 11 is a partial circuit diagram of an ignition device according to a fourth embodiment of the present invention; and, FIG. 12 is a partial circuit diagram of an ignition device according to a fifth embodiment of the present invention.

Referring to FIG. 11, reference number 200 represents a drive circuit, 210 a waveform shaping circuit, 220 a monostable multivibrator, and 230 a magnetic pick-up. The magnetic pick-up 230 is mounted in the distributor 17*a* and an output of the magnetic pick-up 230 is shaped to a rectangular wave in the wave-form shaping circuit 210. The monostable multivibrater 220 is a monostable circuit consisting of a monostable multivibrater and decides the discharge timing corresponding to the second ignition command signal. That is, this circuit 220 outputs a monostable time of approximately 2 msec in synchronization with the trailing edge of the output signal from the waveform shaping circuit 210.

Moreover, the first primary coil 13 and the third primary coil 20 are provided in parallel and the turn ratio between these coils is set to approximately 100 ($N_{11}/N_{13}=100$). In this embodiment, the third primary coil 20 is used as the current cutting type ignition device. After cutting the current in the third primary coil 20, since a new current is provided from the second primary coil 14, it is not necessary to calculate the supply timing of the first and second ignition command signals in the CPU 300.

In the conventional device, fluctuations in the ignition timing are caused by the power source, the leading time of the primary coil, and the primary current cutting value, but in the present invention, the fluctuation of the ignition timing becomes the same as that of the current cutting type ignition device. Of course, the third primary coil 20 and the first primary coil may be connected in series as in the other embodiments.

In the first to third embodiments, the output of the second ignition command signal is applied to the S terminal of the flip-flop circuit 26 or 26*a* through the inverter 28*b* and the OR gate 28*a*. After the current flows in the third primary coil 20, the current flows, to the specified side of the first and second primary coils 13 and 14. In this embodiment, after the current flows in the third primary coil 20, the current can flow to either of the first and second primary coils 13 and 14. Therefore, the inverter 28*b* and the OR gate 28*a* can be omitted in the judging circuit.

Figure 12:
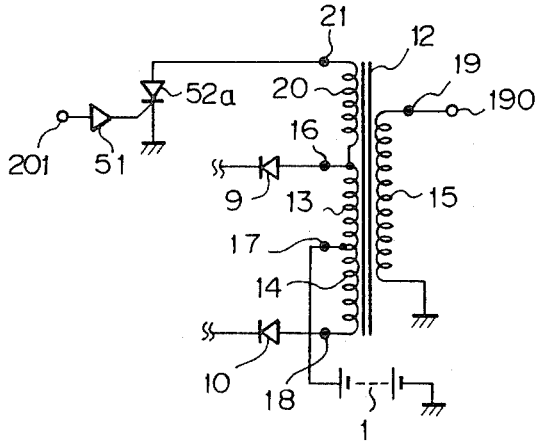

Referring to FIG. 12, a third switching element (for example, a thyristor) 52*a* is provided instead of the transistor 52 and the diode 53 shown in FIG. 1. In this case, the first ignition command signal is applied at the time $t_0$ as a pulse signal having a short width sufficient to turn ON the thyristor 52*a*.

As explained above, in the conventional device, since only the first and second primary coils are provided, the turn ratio between the primary coil and the secondary coil is very large (approximately, 300). Accordingly, the peak voltage (6 to 8 (KV)) and the DC voltage (3 to 4 (KV)) are produced when the current starts to flow in the primary coil. These voltages are applied to the ignition plug, and thus a problem occurs in that a too advanced ignition is performed.

In the present invention, the supplementary energizing circuit including the third primary coil and the drive circuit is newly provided in the ignition device. Moreover, the first and second ignition command signals are newly set and these signals are used for controlling various timings. Since only the third primary coil is energized when the ignition coil initially turns ON, only the peak voltage (2 (KV)) and the DC voltage (1 (KV)) are produced. This is because the turn ratio between the third primary coil and the secondary coil is set to approximately 100. Therefore, it is possible to solve the problem of a too advanced ignition timing.

Since the too advanced ignition is prevented, it is also possible to solve the problems of engine knock and pre-or post-ignition.

Moreover, in the present invention, the number of turns of the first primary coil is set to the same number of turns as that of the second primary coil, and the third primary coil is connected in series to the first primary coil. Therefore, when the ignition coil is initially turned ON, the current flows to a series circuit consisting of the first and third primary coil, and thus, the first primary coil is effectively utilized and the number of turns of the third primary coil can be reduced to be only the number of turns of the first primary coil. Consequently, it is also possible to miniaturize the ignition coil based on the number of turns thereof, the turn ratio, and the connections explained above.

We claim:

1. An ignition device for an internal combustion engine comprising:

a direct current power source providing a direct current voltage;

an ignition coil having first, second and third primary coils and a secondary coil;

a first switching element forming a first closed circuit together with the direct current power source and the first primary coil;

a second switching element forming a second closed circuit together with the direct current power source and the second primary coil;

a reverse current-flow preventive element defining a current-flow direction in one direction in the first and second closed circuits;

current detection elements for detecting current-flow in the first and second closed circuits;

a third switching element forming a third closed circuit together with the direct current power source and the first and third primary coils;

an ignition command signal generating means for repeatedly producing at every ignition timing, a first ignition command signal to command turning ON of the third closed circuit, and a second ignition command signal to command turning ON of the first and second closed circuits after a delay of a predetermined time from the timing of the first ignition command signal; and a control circuit for causing the first and second switching elements to push-pull operate in such a way that when the second ignition command signal is input and a current flow in one side of the first and second closed circuits reaches a predetermined value, a first signal cutting the current flow in one side of the first and second closed circuits is applied to one side of the first and second switching elements, and a second signal starting the other current flow is applied to the other side of the first and second switching elements.

2. An ignition device as claimed in claim 1, wherein said third primary coil of the ignition coil has a number of turns greater than that of the first and second primary coils.

3. An ignition device as claimed in claim 1, wherein said first and second primary coils have approximately the same number of turns, and said third primary coil is connected in series to the first primary coil.

4. An ignition device as claimed in claim 1, wherein said third switching element is constituted by a series circuit consisting of a transistor and a diode.

5. An ignition device as claimed in claim 3, wherein said first and second primary coils are energized by a direct current power source in such a way that currents flow in these coils in a reverse direction to each other, said third primary coil being energized by the direct current power source in such a way that current flows in this coil in the same direction as that of the first primary coil.

6. An ignition device as claimed in claim 5, wherein said control circuit applies a turning ON signal to allow current to flow from the first closed circuit to the first switching element before being applied to the second closed circuit.

7. An ignition device as claimed in claim 5, wherein said ignition command signal generating means produces a second ignition command signal in such a way that just after the first ignition command signal is output, said control circuit applies a turning ON signal to allow a current flow from the second closed circuit to the second switching element before being applied to the first closed circuit.

8. An ignition device as claimed in claim 6, wherein said third switching element is a thyristor.

9. An ignition device for an internal combustion engine comprising:

a direct current power source providing a direct current voltage;

an ignition coil having a main primary coil connected to the direct current power source at one end, a supplementary primary coil connected to the main primary coil, and a secondary coil;

a main switching element connected between the common connecting point of the other end of the main primary coil and the supplementary primary coil and the other end of the direct current power source, for supplying current from a direct current power source to the main primary coil when turned ON;

a supplementary switching element connected between the other end of the supplementary primary coil and the direct current power source, for supplying the current from the direct current power source to the main primary coil and the supplementary primary coil when turned ON;

an ignition command signal generating means for producing a first ignition command signal for turning ON the supplementary switching element, and a second ignition command signal for turning ON the main switching element just before the ignition timing after a delay of only a predetermined time from the first ignition command signal, and then turning OFF the main switching element at the ignition timing; and an ignition plug connected to the secondary coil, for producing an ignition spark by high output voltage generated across the secondary coil caused by cutting off the main primary coil based on the turning OFF of the main switching element.

* * * * *